United States Patent [19]

Giladett

[11] Patent Number: 4,619,199

[45] Date of Patent: Oct. 28, 1986

[54] SAFING AND ARMING MECHANISM

[75] Inventor: Leo V. Giladett, Santa Cruz, Calif.

[73] Assignee: The United States of America as represented by the Secretary of the Air Force, Washington, D.C.

[21] Appl. No.: 636,454

[22] Filed: Jul. 31, 1984

[51] Int. Cl.[4] ..... F42C 15/36

[52] U.S. Cl. ..... 102/254; 89/1.14; 60/635; 60/636; 102/229

[58] Field of Search ..... 89/1.14, 1.55; 411/390, 411/391; 60/636, 632, 635, 634, 636, 638; 102/229, 223, 254

[56] References Cited

U.S. PATENT DOCUMENTS

| | | | |
|---|---|---|---|
| 3,119,302 | 1/1964 | Barr | 60/632 X |
| 3,133,408 | 5/1964 | Stott | 89/1.14 X |
| 3,200,706 | 8/1965 | Kinard | 89/1.14 |
| 3,218,927 | 11/1965 | Stott | 60/636 X |
| 3,277,766 | 10/1966 | Burkdoll | 411/391 |
| 3,352,189 | 11/1967 | Brown | 411/391 |
| 3,530,759 | 9/1970 | Francis | 89/1.14 X |
| 3,618,522 | 11/1971 | Henderson | 102/254 X |
| 3,625,106 | 12/1971 | Russo et al. | 89/1.55 |
| 3,722,407 | 3/1973 | Fogal et al. | 102/229 X |
| 3,889,598 | 6/1975 | Belsley | 102/229 |
| 3,902,400 | 9/1975 | Kincheloe et al. | 89/1.14 |
| 3,961,577 | 6/1976 | O'Steen | 89/1.55 |
| 4,158,322 | 6/1979 | Hardesty | 89/1.14 |

*Primary Examiner*—David H. Brown

*Attorney, Agent, or Firm*—Donald J. Singer; Thomas L. Kundert

[57] ABSTRACT

An out-of-line safing and arming mechanism (10) includes an explosive chain (12) having one link (24) movably mounted on a slider (30) to be removed from the chain in a safing configuration and to be located in the chain in an arming configuration. A head (42) prevents the slider from moving into an arming position and is attached to the slider by an annular connecting system (44) which is stronger in tension and compression than it is in shear. The connecting section is broken by activation of an explosive charge (62) which is located within the connecting section and generates forces (66) tending to shear the connecting section as well as forces (64) tending to move the slider toward an arming position.

7 Claims, 5 Drawing Figures

SAFING AND ARMING MECHANISM

RIGHTS OF THE GOVERNMENT

The invention described herein may be manufactured and used by or for the Government of the United States for all governmental purposes without the payment of any royalty.

BACKGROUND OF THE INVENTION

The present invention relates generally to arming systems, and particularly to safing and arming systems using explosive trains.

In existing weapons, such as bombs, or the like, a potential exists for an inadvertent arming thereof in the event the weapon is mishandled prior to use. These weapons often employ out-of-line safety mechanisms powered by explosive charges as a means for preventing the inadvertent arming of the weapon due to such mishandling. Such out-of-line safety mechanisms often include an explosive chain in which one link thereof is located out of the chain thereby interrupting the chain in a weapon-safe condition, and then is moved into the chain to establish a weapon-armed condition.

To be effective, any weapon safing and arming mechanism should be secure enough to completely ensure that a weapon remains safe when necessary. Yet to be totally safe and effective in use, such a mechanism should not assume an arming configuration until the last possible instant. That is, the safing and arming mechanism should be stable and secure in a safing condition, yet be able to move into an arming condition as rapidly and as precisely as possible so arming a weapon will be reliable and can be delayed until the most desirable instant.

In the past, arming and safing mechanisms such as disclosed in Report AFATL-TR-79-80 have been designed to solve these apparently conflicting requirements by mounting the explosive chain movable link on a slider which is securely held in the weapon safing condition and is freed by an explosive charge which breaks the slider in tension or collapses it under compression. However, in these mechanisms, because the slider is simply overpowered to be released, the slider is freed and moved into a weapon arming position by the same forces which, in effect, cross-couple those slider freeing and moving forces.

The above-discussed conflicting requirements of security and stability in a safing configuration yet rapid and precise movement into a weapon arming configuration presents many problems for mechanisms in which the slider disengaging and moving forces are cross-coupled. In such cross-coupled mechanisms, the unlocking force must be large enough to overpower a slider which, itself, must be quite strong in order to insure safety, thereby exposing an unlocked slider to moving forces which may be far larger than necessary or desirable for moving the slider into a weapon arming condition. Therefore, using the same forces to both unlock a slider which is securely held in a safe condition, and move that slider into an arming configuration may make the mechanism difficult to control with precision.

SUMMARY AND OBJECTS OF THE INVENTION

It is therefore a main objective of the present invention to provide a new and improved fuze safing and arming mechanism which is securely held in a device safing configuration yet which is precisely and reliably moved into a device arming configuration.

It is another object of the present invention to provide a novel and improved fuze safing and arming mechanism in which slider freeing forces are different from those forces which are used to move the mechanism into an armed configuration.

It is another object of the present invention to provide a novel and improved fuze safing and arming mechanism in which the forces used to move the mechanism into a device arming configuration can be controlled with a high degree of precision.

It is a more specific object of the present invention to provide a novel and improved device fuze safing and arming mechanism in which a slider stop is failed in shear as opposed to failure in tension or compression. Forces which would impose tension or compression forces on the slider are then used to move the mechanism into an arming configuration.

It is another specific object of the present invention to provide a novel slider mechanism which is movable but held in one position by a means which is stronger in the direction of slider movement than it is in a direction transverse to slider movement.

These and other objects are accomplished by the arming and safing mechanisms embodying the present invention. The mechanism includes an out-of-line safety mechanism which has a movable link of an explosive train mounted on a slider. The slider is held in a safing position by a stop which is coupled to the slider by a hollow connecting means. A force generator, such as an explosive charge, is located inside the connecting means and is activated by a system in the device being armed. Upon activation, forces are applied to the connecting means in a direction which tend to establish shear forces on that connecting means. The force generator also produces forces which are exerted on the slider axially thereof to move an unlocked slider toward a device arming position. The connecting means and slider are designed to be quite strong in tension or compression, and the connecting means is designed to be easily failed in shear. Therefore, the slider can be quite securely held against rough handling, yet a released slider can be controlled for precise movement as the slider-moying forces are not constrained by any need to be strong enough to free a securely held slider. The force generator is preferably an explosive charge, and the device is preferably a weapon with a slider being of one-piece construction. The explosive charge can be mounted in a connecting means chamber which is shaped to orient the explosive gas created forces to accomplish the just-described orientation of forces on the slider connecting means and on the slider itself.

DETAILED DESCRIPTION OF THE INVENTION

Figures 1, 1A, 2, 2A, 3:
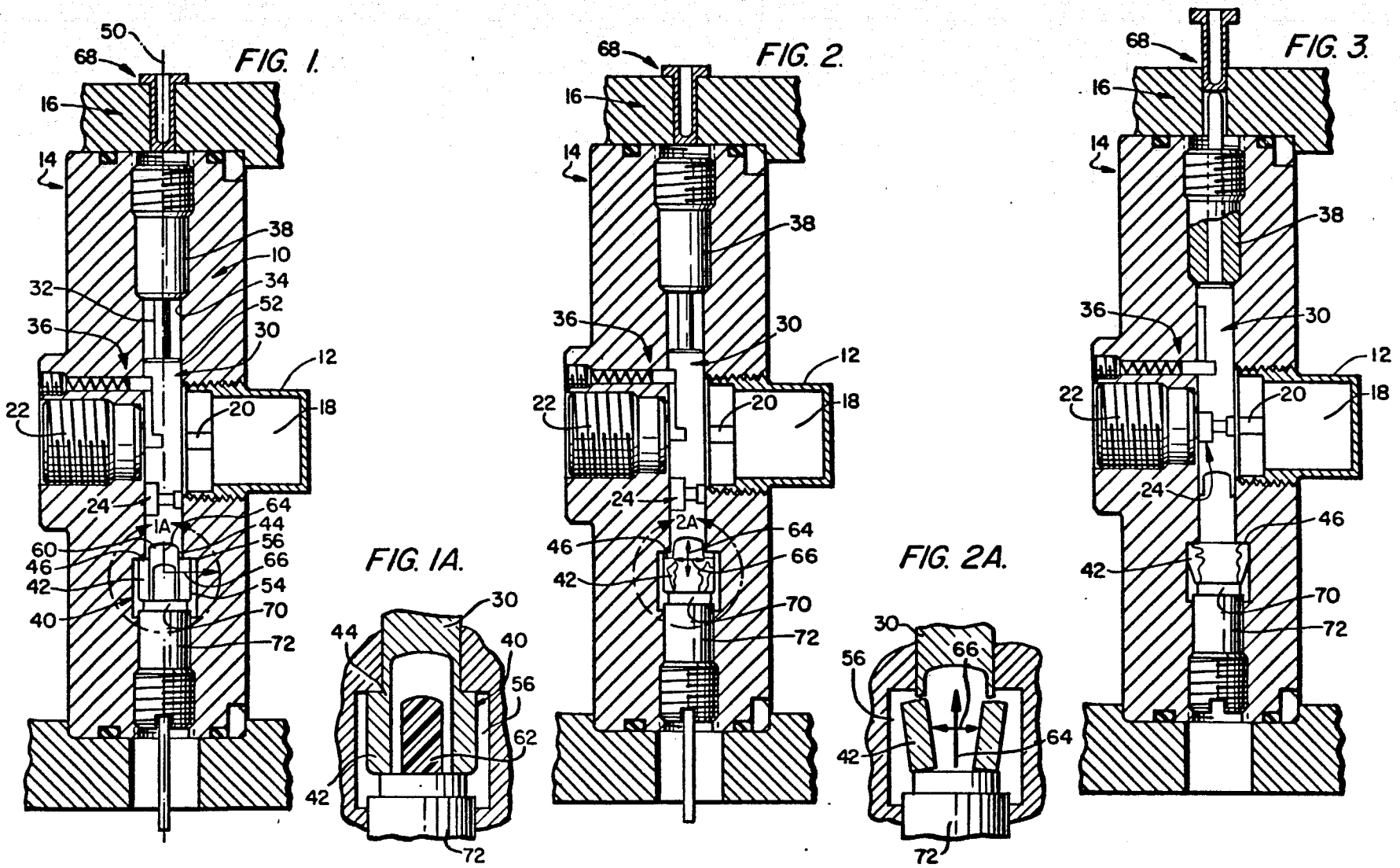
FIG. 1 is a schematic of a safing and arming mechanism embodying the present invention in a safing configuration.
FIG. 1A is a view of the holding means for the slider in the attached configuration.
FIG. 2 is a schematic of the safing and arming mechanism of the present invention in an unlocking configuration.
FIG. 2A is a view of the holding means for the slider just after separation from the slider.
FIG. 3 is a schematic of the safing and arming mechanism of the present invention in an arming configuration.

Shown in FIG. 1 is an out-of-line safing and arming mechanism 10 for use in an explosive train 12 located in a body 14 of a device, such as a weapon 16, or the like. Explosive train 12 includes a booster charge 18 and a lead charge 20 which are coupled to a firing mechanism 22 by a movable detonator 24 which is located in the chain to arm the weapon and out of the chain to render the weapon safe. The detonator is mounted on an elongate slider 30 mounted in a bore 34 of body 14 to be axially movable. The mechanism 10 includes a lock system having a spring loaded latch 36 and an abutment 38 for locking the slider in an arming position.

Mechanism 10 further include a stop 40 for preventing slider 30 from moving into an arming position. The slider 30 includes a head 42 integrally mounted on one end of slider 30 by a connecting section 44. The head abuts a shoulder 46 defined in body 14 to hold the slider in a weapon-safing configuration. The connecting section is an annulus which is stronger in tension and compression than it is in shear. For the purposes of this disclosure, tension and compression forces are defined as forces directed axially of the slider and connecting means along centerline 50 thereof, and shear forces are defined as forces directed transversely of the slider and connecting means centerline 50.

The slider has an outer surface 52 abutting body 14 adjacent to shoulder 46, and the head has an outer circumferential surface 54 spaced from body 14 to define a gap 56 adjacent to shoulder 46. Therefore shear forces directed outwardly of centerline 50 adjacent to the shoulder 46 will tend to break the connecting section in shear adjacent to shoulder 46.

The head 42 is hollow so head 42 plus annular connecting section 44 together with the slider end define a cavity 60 for accommodating a detaching means 62. Preferably the detaching means includes an explosive charge detonated by control means located in the weapon. Once activated, the detaching means will generate forces 64 oriented along centerline 50 as well as forces 66 oriented transversely of centerline 50.

Forces 66 force the head outwardly toward gap 56 thereby creating shear forces on the connecting section 44 adjacent to shoulder 46; while forces 64 act axially of the slider. The shear forces break the connecting means adjacent to the shoulder as indicated in FIG. 2 thereby freeing that slider to move within bore 34 away from the detaching means under the influence of the axially directed forces 64 acting on the end of the slider. The cavity can be shaped to orient forces 64 in a manner which is most effective in moving a freed slider. The slider moves until it assumes an arming position such as shown in FIG. 3 whereat lock system 36 arrests further axial movement of the slider. The forces 64 and 66 can be adjusted so forces 66 are strong enough to break the connecting means yet forces 64 do not cause the slider to move so fast that it cannot be reliably and precisely controlled by lock system 36.

Connecting section 44 is designed to be strong in tension or compression yet relatively weak in shear. As most accidental arming is caused by forces acting to compress or stretch the slider, the strength of the connecting section can be tailored to ensure that mechanism will not be overpowered by rough handling. However, since the connecting section is weak in shear, a weak charge will be sufficient to free the slider. As the charge is weak, the freed slider will be easier to control and to stop in a weapon arming position than if a large charge is required which would require that the latch 36 and abutment 38 be designed to stop a rapidly moving slider. The connecting section can thus be designed to have as much strength as necessary to insure safety, yet be as weak as necessary to ensure rapid, controllable arming, since the design criteria of a weapon safing function are not cross coupled to the design criteria of the weapon arming function. Both functions can therefore be carried out with extreme accuracy.

While mechanism 10 has been disclosed in a weapon, other applications are possible without departing from the scope of the present disclosure. For example, the explosive train can include a lead charge carried out of line on the slider with the detonator and a leadout charge being fixed. The slider can have a porthole defined therein with the detonator and lead-out charge being fixed. In this latter case, the slider acts as a blocking shutter in the device safe configuration. In short, the present mechanism is suitably used in conjunction with any explosive train using interruption to assure safety. A signal 68 can also be used to signal an armed configuration if suitable, and any suitable means can be used to support detaching means 62 in position within cavity 60. For example, the detaching means can be affixed to a ferrule 70 which is retained in contact with slider head 42 by a retainer member 72.

I claim:

1. An out-of-line safing and arming mechanism for use with an explosive train in which a movable link couples on portion of the train to another when the explosive train is armed comprising:

a slider means for moving the movable link along a predetermined direction between an explosive train safing position in which the train is interrupted and an explosive train arming position;

stop means for preventing said slider means from moving into said explosive train arming position;

a hollow connecting means structurally interconnecting said stop means and said slider means; and detaching means disposed within said hollow connecting means for generating forces against said connecting means, said forces including a component transverse of said predetermined direction for breaking said connecting means in shear to break the interconnection of said stop means and said slider means, and said forces including a component along said predetermined direction and directed against said slider means for moving said slider means toward said explosive train arming position.

2. The safing and arming mechanism defined in claim 1 wherein said connecting means is substantially stronger along said predetermined direction than it is transverse of said direction.

3. The safing and arming mechanism defined in claim 1 wherein said detaching means comprises an explosive charge.

4. The safing and arming mechanism defined in claim 1 further comprising a spring loaded locking means adjacent said slider means for locking said slider means in said arming position.

5. An out-of-line safing and arming mechanism for use in arming a weapon in which an explosive train includes a movable link coupling one portion of the train to another when the weapon is armed, comprising:

a one-piece slider means mounted in the weapon for moving the movable link along a predetermined direction between a weapon safe position in which the explosive train is interrupted and a weapon armed position, said slider including:

stop means near one end of said slider means for preventing said slider means from moving into said weapon armed position;

a hollow connecting means interconnecting said stop means at said one end of said slider means;

detaching means in said hollow connecting means for generating forces having a component directed against said connecting means which break said connecting means in shear to disconnect said stop means from said slider means and a component directed axially of said slider means for moving said slider means toward said weapon armed position; and spring loaded locking means adjacent said slider means for locking said slider means in said armed position.

6. The safing and arming mechanism defined in claim 5 wherein said connecting means is substantially stronger along said predetermined direction than it is transverse of said direction.

7. The safing and arming mechanism defined in claim 5 wherein said detaching means is an explosive charge.

* * * * *

UNITED STATES PATENT AND TRADEMARK OFFICE

CERTIFICATE OF CORRECTION

PATENT NO. : 4,619,199

DATED : October 28, 1986

INVENTOR(S) : Leo V. Giladett

It is certified that error appears in the above-identified patent and that said Letters Patent is hereby corrected as shown below:

Column 2, line 46, "slider-moying" should be ---slider-moving---.

Column 4, line 19, "leadout" should be ---lead-out---.

Column 4, line 35, in claim 1, "on" should be ---one---.

Signed and Sealed this

Twenty-eighth Day of April, 1987

*Attest:*

DONALD J. QUIGG

*Attesting Officer*

*Commissioner of Patents and Trademarks*